US010099877B2

(12) United States Patent
Tanaka

(10) Patent No.: US 10,099,877 B2
(45) Date of Patent: Oct. 16, 2018

(54) SHEET FEED CONVEYANCE DEVICE AND IMAGE FORMING APPARATUS

(71) Applicant: KYOCERA Document Solutions Inc., Osaka (JP)

(72) Inventor: Yuichiro Tanaka, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/786,182

(22) Filed: Oct. 17, 2017

(65) Prior Publication Data

US 2018/0118487 A1 May 3, 2018

(30) Foreign Application Priority Data

Oct. 27, 2016 (JP) ..... 2016-210828

(51) Int. Cl.

| | |
|---|---|
| ***B65H 7/02*** | (2006.01) |
| ***B65H 7/14*** | (2006.01) |
| ***G03G 15/00*** | (2006.01) |
| ***B65H 3/06*** | (2006.01) |

(Continued)

(52) U.S. Cl.

CPC ..... *B65H 7/02* (2013.01); *B65H 3/0638* (2013.01); *B65H 5/06* (2013.01); *B65H 7/06* (2013.01); *B65H 7/14* (2013.01); *G03G 15/505* (2013.01); *G03G 15/553* (2013.01); *B65H 3/06* (2013.01); *B65H 2513/10* (2013.01); *B65H 2513/52* (2013.01); *B65H 2557/652* (2013.01); *B65H 2601/522* (2013.01)

(58) Field of Classification Search

CPC ... B65H 7/02; B65H 7/14; B65H 7/18; B65H 7/20; B65H 2513/10; B65H 2513/514; B65H 2513/511; B65H 2513/52; B65H 2511/417

See application file for complete search history.

(56) References Cited

U.S. PATENT DOCUMENTS 8,091,884 B2 * 1/2012 Furukawa ..... B65H 7/12 271/110
8,561,985 B2 * 10/2013 Ishizaki ..... B65H 7/06 271/265.01

(Continued)

FOREIGN PATENT DOCUMENTS

JP 2000095371 A * 4/2000
JP 2003-182872 A 7/2003

(Continued)

*Primary Examiner* — Luis A Gonzalez

(74) *Attorney, Agent, or Firm* — Studebaker & Brackett PC

(57) ABSTRACT

A sheet feed conveyance device includes a warning section, a pickup roller that feeds a sheet, a separation section, a speed sensor that detects a conveyance speed of the sheet, and a controller. The separation section includes a feed roller that feeds downstream the sheet fed by the pickup roller and a retard roller that returns a sheet involved in multiple sheet feeding toward the pickup roller. The controller recognizes the conveyance speed based on output of the speed sensor, integrate conveyance speeds detected in a measurement time period from rotation start of the pickup roller to elapse of a specific time period, and determines necessity for maintenance of the pickup roller according to a measurement distance as a result of integration.

12 Claims, 8 Drawing Sheets

(51) Int. Cl.
*B65H 5/06* (2006.01)
*B65H 7/06* (2006.01)

(56) References Cited

U.S. PATENT DOCUMENTS

| | | | | |
|---|---|---|---|---|
| 8,949,039 | B2 * | 2/2015 | Yasukawa | B65H 5/062 702/34 |
| 9,300,823 | B1 * | 3/2016 | Adachi | H04N 1/00344 |
| 2005/0050423 | A1 * | 3/2005 | Yasukawa | B41J 29/38 714/742 |
| 2015/0301491 | A1 * | 10/2015 | Yoshikawa | B65H 5/062 271/3.16 |

FOREIGN PATENT DOCUMENTS

| | | | |
|---|---|---|---|
| JP | 2005206307 | A * | 8/2005 |
| JP | 2011144033 | A * | 7/2011 |

* cited by examiner

SHEET FEED CONVEYANCE DEVICE AND IMAGE FORMING APPARATUS

INCORPORATION BY REFERENCE

The present application claims priority under 35 U.S.C. § 119 to Japanese Patent Application No. 2016-210828, filed on Oct. 27, 2016. The contents of this application are incorporated herein by reference in their entirety.

BACKGROUND

The present disclosure relates to a sheet feed conveyance device that feeds a sheet using a roller. The present disclosure further relates to an image forming apparatus including the sheet feed conveyance device.

There are known image forming apparatuses such as a multifunction peripheral, a copier, and a printer. A sheet of paper is set in an image forming apparatus. The sheet of paper is fed and conveyed. A sheet feed roller may be included in the image forming apparatus for sheet feeding. The sheet feed roller comes in contact with the sheet. The sheet feed roller rotates during sheet feeding. Friction force of the feed roller with the sheet is utilized for feeding the sheet. Friction causes abrasion of the sheet feed roller. It is necessary to replace the sheet feed roller before the sheet feed roller is abraded to such a degree that the sheet feed roller is disabled from feeding a sheet. In view of the foregoing, the lifetime of the sheet feed roller may be detected (estimated).

A sheet feed conveyance device is known that feeds a recording medium from a recording medium accommodation site, performs separation on the fed recording medium using a recording median separation section, and then temporarily stops the separated recording medium. After temporarily stopping the recording medium, the sheet feed conveyance device conveys the recording medium with desired timing toward a registration roller disposed before a site where an image transfer is performed. The sheet feed conveyance device estimates the lifetime of the sheet feed roller based on a e period from restarting after temporarily stopping the recording medium to passing of the recording medium over a sensor disposed downstream. In a conveyance method using the above sheet feed device in which the recording medium is fed, subjected to separation, temporarily stopped after a specific time period, and then re-conveyed with predetermined timing, the lifetime of the sheet feed roller is detected.

SUMMARY

A sheet feed conveyance device according to the present disclosure includes a warning section, a pickup roller, a separation section, a speed sensor, and a controller. The warning section issues a warning. The pickup roller feeds a sheet placed on a placement plate. The separation section is disposed downstream of the pickup roller in a conveyance direction of the sheet. The separation section includes a feed roller and a retard roller. The feed roller feeds downstream the sheet fed by the pickup roller. The retard roller is in contact with the feed roller to form a nip and returns a sheet involved in multiple sheet feeding toward the pickup roller. The speed sensor is disposed upstream of the pickup roller in the conveyance direction. The speed sensor detects a conveyance speed of the sheet fed from the placement plate. The controller causes the pickup roller to rotate during sheet feeding. The controller recognizes the conveyance speed based on output of the speed sensor. The controller integrates conveyance speeds detected in a measurement time period that is a time period from rotation start of the pickup roller to elapse of a specific time period. The controller determines necessity for maintenance of the pickup roller according to a measurement distance that is a conveyance distance as a result of integration. Upon determining that maintenance of the pickup roller is necessary, the controller causes the warning section to issue a warning about maintenance of the pickup roller.

DETAILED DESCRIPTION

The following describes an embodiment of the present disclosure reference to FIGS. 1-9. In the following description, an image forming apparatus including a sheet feed conveyance device 1 will be discussed as an example. A printer 100 is adopted as an example of the image forming apparatus. Note that elements in the following embodiment such as configuration and positioning are merely examples provided to facilitate explanation and do not in any way limit the scope of the present disclosure.

(Brief of Image Forming Apparatus)

Figure 1:
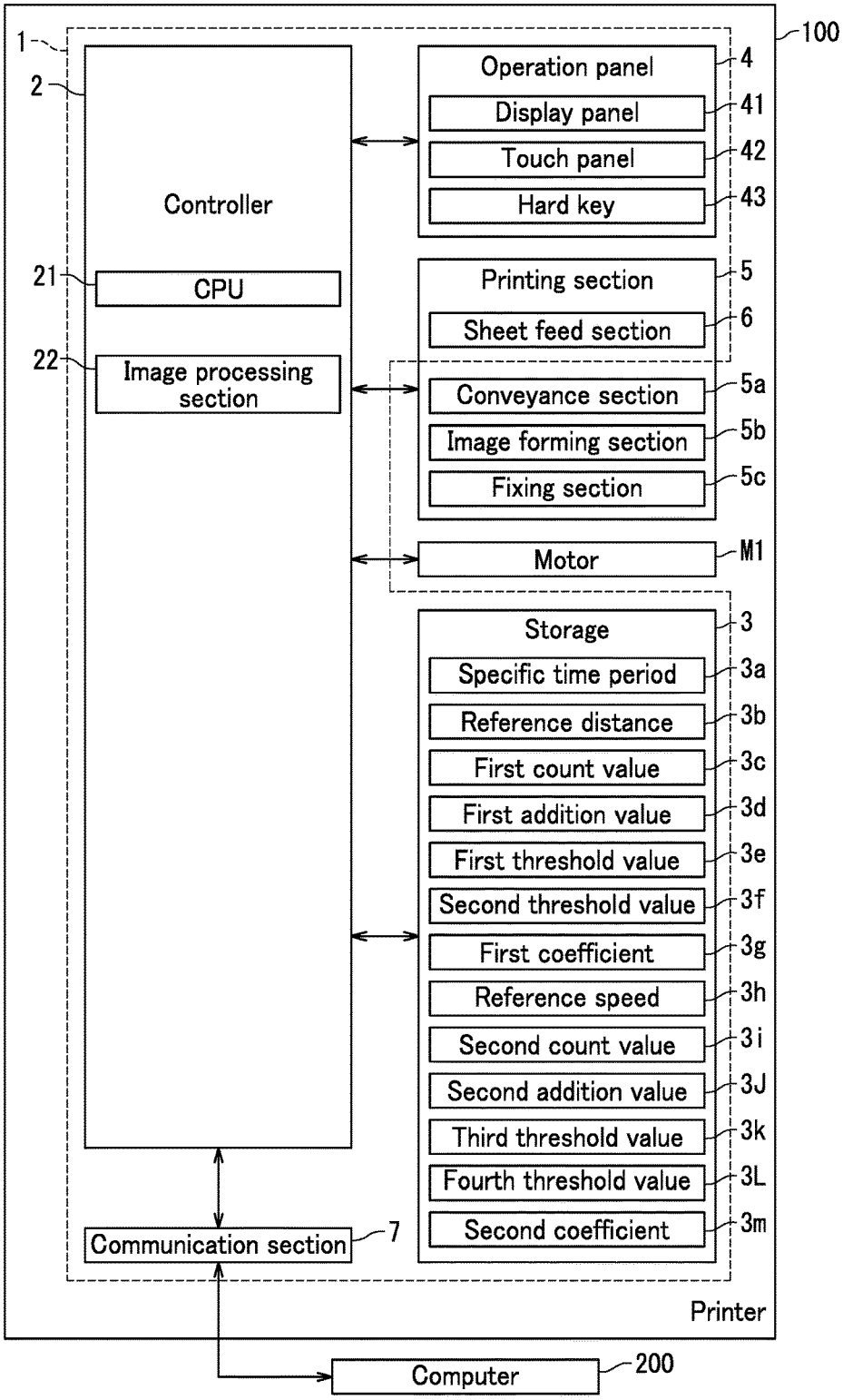
FIG. 1 is a block diagram illustrating an example of a printer according to an embodiment.

The printer 100 according to the embodiment will be described first with reference to FIG. 1. FIG. 1 is a block diagram illustrating an example of the printer 100 according to the embodiment.

The printer 100 includes a controller 2 and a storage 3. The controller 2 supervises overall operation of the printer 100 and controls respective elements of the printer 100. The controller 2 also controls operation of the sheet feed conveyance device 1. The controller 2 includes an image processing section 22 and a processor such as a CPU 21. The CPU 21 performs arithmetic operation and processing for control on the printer 100. The image processing section 22 performs image processing necessary for printing on image data. The storage 3 includes a storage device such as read only memory (ROM), random access memory (RAM), or a hard disk drive (HDD). The storage 3 stores therein control programs and data.

The controller 2 is communicably connected to an operation panel 4. The operation panel 4 includes a display panel 41 (corresponding to a warning section), a touch panel 42, and a hard key 43. The controller 2 controls display of the display panel 41. The controller 2 causes the display panel 41 to display a setting screen, a state of the printer 100, and messages. The controller 2 further causes the display panel 41 to display an operation image. The operation image includes for example a soft key or a soft button. The controller 2 recognizes operation to an operation image based on output of the touch panel 42. The controller 2 also recognizes operation to the hard key 43. The controller 2 controls the display panel 41 to switch to a screen corresponding to the operation on the operation image or the hard key 43. The controller 2 controls the printer 100 to operate according to setting set through the operation panel 4.

The printer 100 includes a printing section 5. The printing section 5 performs printing on a sheet. The printing section 5 includes a sheet feed section 6, a conveyance section 5*a*, an image forming section 5*b*, and a fixing section 5*c*. The controller 2 controls respective operations of the sheet feed section 6, the conveyance section 5*a*, the image forming section 5*b*, and the fixing section 5*c*. The controller 2 controls processing pertaining to printing such as sheet conveyance, and formation, transfer, and fixing of a toner image. The printing section 5 will be described later in detail.

The printer 100 further includes a communication section 7 (corresponding to warning section). The communication section 7 is a communication interface with a computer 200. The computer 200 refers to a personal computer or a server. The communication section 7 receives print data from the computer 200. The print data includes data indicating printing content (image data or data described in page description language) and data indicating setting content. The controller 2 causes the printing section 5 to perform printing based on the print data.

(Printing Section 5)

Figure 2:
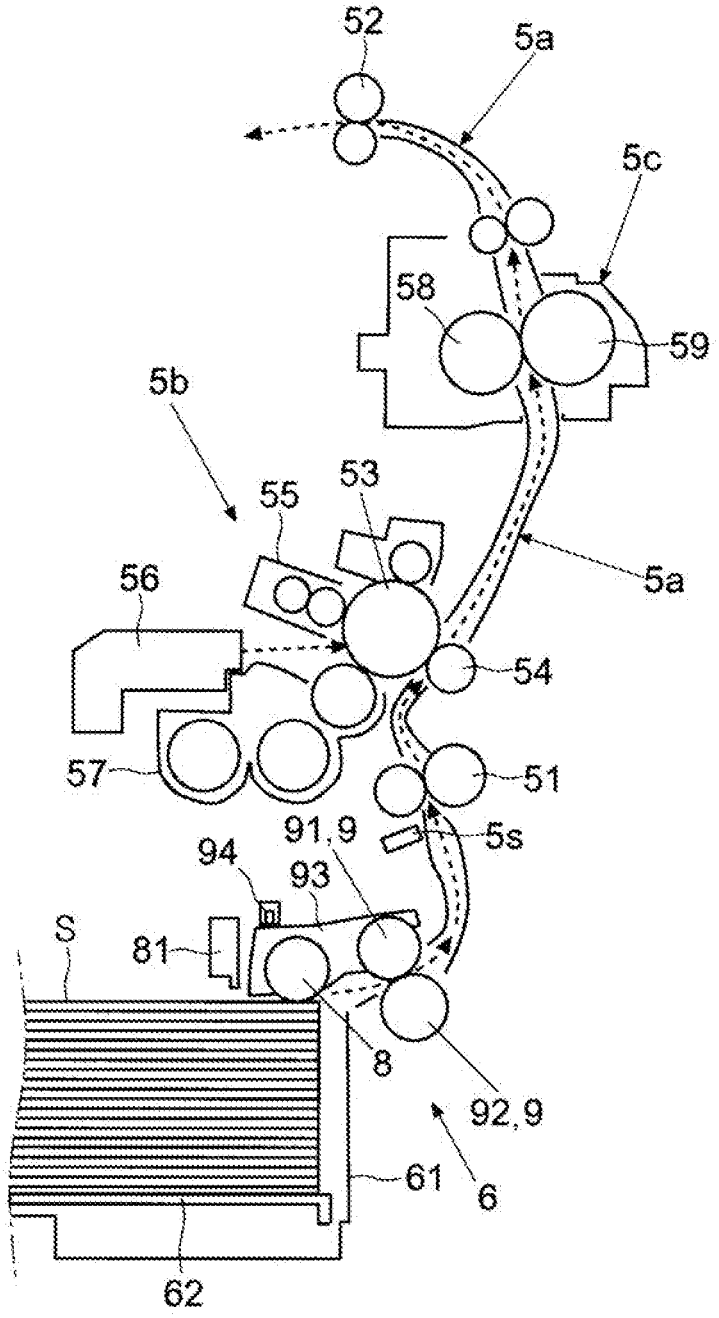
FIG. 2 is a diagram illustrating an example of a printing section according to the embodiment.

An example of the printing section 5 according to the embodiment will be described next with reference to FIG. 2. FIG. 2 is a diagram illustrating an example of the printing section 5 according to the embodiment.

The printing section 5 includes the sheet feed section 6, the conveyance section 5*a*, the image forming section 5*b*, and the fixing section 5*c*. In printing, the controller 2 causes the sheet feed section 6 to feed a sheet S toward the conveyance section 5*a*. The controller 2 also causes the sheet feed section 6 to convey the sheet S. The sheet S is for example plain paper, copy paper, recycled paper, glossy paper, or overhead projection (OHP) paper. The sheet feed section 6 will be described later in detail. The conveyance section 5*a* includes a registration roller pair 51 and an ejection roller pair 52. The controller 2 causes the conveyance section 5*a* to convey the sheet S fed from the sheet feed section 6 inside the printer 100. The sheet S having been subjected to printing (fixing) is ejected out of the printer 100 by the ejection roller pair 52.

The image forming section 5*b* includes a photosensitive drum 53, a transfer roller 54, a charger 55, an exposure device 56, and a developing device 57. The controller 2 causes the image forming section 5*b* to form a toner image (image) that is to be transferred to the sheet S conveyed by the conveyance section 5*a*. The controller 2 further causes the image forming section 5*b* to transfer the toner image to the sheet S. The fixing section 5*c* includes a heating roller 58 and a pressure roller 59. The controller 2 causes the fixing section 5*c* to fix the transferred toner image to the sheet S.

The conveyance section 5*a* includes a conveyance path extending vertically on the right side of the sheet feed section 6. As illustrated in FIG. 2, a sheet sensor 5*s* is disposed in the middle of the conveyance path. The sheet sensor 5*s* is disposed between the sheet feed section 6 and the registration roller pair 51. The sheet sensor 5*s* is disposed downstream of the sheet feed section 6 in a sheet conveyance direction. The sheet sensor 5*s* is disposed in the upstream vicinity of the registration roller pair 51.

The sheet sensor 5*s* detects arrival of a leading edge of the sheet S (also referred to below as "leading edge arrival" or "arrival of a sheet S") and passing of a tailing edge of the sheet S (also referred to below as "passing of a sheet S"). The sheet sensor 5*s* is for example an optical sensor. The sheet sensor 5*s* changes the level of its output signal according to whether the sheet S conveyed through the conveyance path is present or absent at a location corresponding to that of the sheet sensor 5*s*. The output signal of the sheet sensor 5*s* is input to the controller 2. Based on the output signal, the controller 2 recognizes arrival and passing of the sheet S at and over the sheet sensor 5*s* or the registration roller pair 51 in the vicinity of the sheet sensor 5*s*.

The controller 2 controls a motor M1 (see FIG. 1) disposed in a main body of the printer 100 and an electromagnetic clutch (not illustrated) disposed at the registration roller pair 51. The controller 2 controls rotation of the registration roller pair 51. The controller 2 causes the registration roller pair 51 not to rotate at arrival of the sheet S. The leading edge of the sheet S abuts on a nip of the registration roller pair 51. This warps the sheet S. The leading edge of the sheet S warped to have resilience is leveled off along the nip of the registration roller pair 51. As a result, skew of the sheet S is corrected. After the sheet S is warped, the controller 2 causes the registration roller pair 51 to rotate. The controller 2 causes the registration roller pair 51 to feed the sheet S so that the toner image is transferred to the sheet S without displacement.

The controller 2 causes the motor M1 (see FIG. 1) to rotate during printing. The motor M1 rotates rotors included in the printing section 5 for conveyance of the sheet S. For example, the motor M1 rotates the registration roller pair 51, rotors (photosensitive drum 53 and transfer roller 54) of the image forming section 5*b*, the rotors (heating roller 58 and pressure roller 59) of the fixing section 5*c*, and the ejection roller pair 52.

(Sheet Feed Conveyance Device 1)

Figure 3:
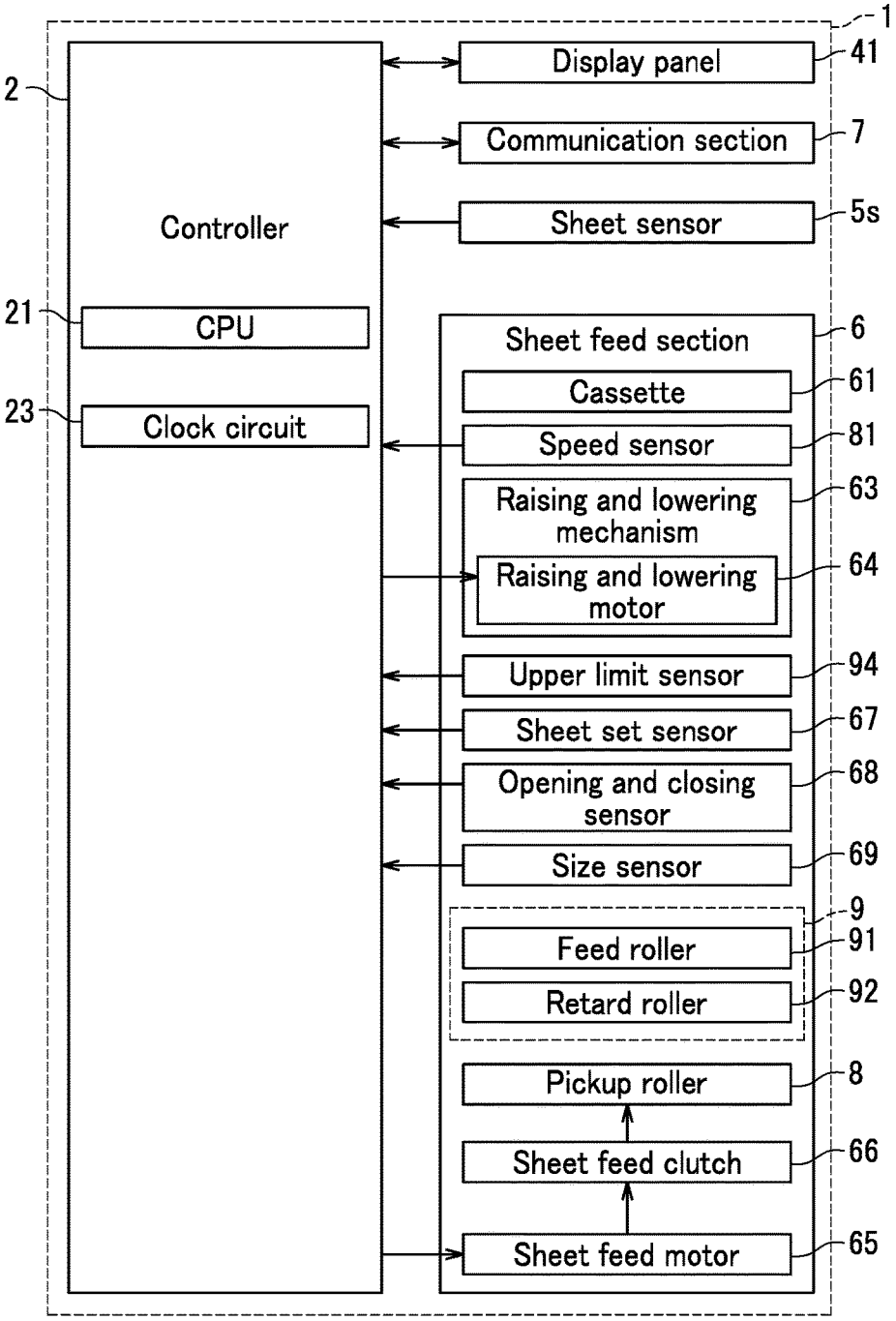
FIG. 3 a block diagram illustrating an example of a sheet feed conveyance device according to the embodiment.

An example of the sheet feed conveyance device 1 according to the embodiment will be described next with reference to FIGS. 2 and 3. FIG. 3 is a block diagram illustrating an example of the sheet feed conveyance device 1.

The sheet feed conveyance device 1 includes the warning section, the sheet feed section 6, the controller 2, the operation panel 4, and the sheet sensor 5*s*. The sheet feed section 6 includes a pickup roller 8, a separation section 9, and a speed sensor 81. The sheet feed conveyance device 1 is included in the printer 100 (image forming apparatus). The warning section warns (alarms) a user. A combination of the display panel 41 and the communication section 7 corresponds to the warning section in the sheet feed conveyance device 1.

Once execution of a print job starts, the sheet feed section 6 feeds sheets S one at a time. The sheet feed section 6 includes a cassette 61. The cassette 61 accommodates the sheets S. The cassette 61 is capable of being pulled out from a casing of the printer 100. After sheets S are supplemented or replaced, the cassette 61 is closed by the user (accommodated in the casing). The cassette 61 also includes a placement plate 62. The sheets S (sheet sheaf) are placed on the upper surface of the placement plate 62. Note that a regulation plate (not illustrated) is disposed in the cassette 61 for regulating the position of the sheets S.

The placement plate 62 has an upstream end that is supported in a pivotal manner. The upstream end of the placement plate 62 serves as a pivot. The placement plate 62 has a downstream end that is a free end that pivots in an up-and-down direction. As illustrated in FIG. 3, the sheet feed section 6 includes a raising and lowering mechanism 63 that raises and lowers the placement plate 62. The raising and lowering mechanism 63 includes a raising and lowering motor 64. The raising and lowering mechanism 63 is capable of raising and lowering the placement plate 62 by driving force of the raising and lowering motor 64. When the user pulls out (opens) the cassette 61, the raising and lowering mechanism 63 lowers the downstream end of the placement plate 62 until the placement plate 62 is laid down. In printing (sheet feeding), the controller 2 causes the placement plate 62 to be raised to an upper limit level.

The pickup roller 8 and the separation section 9 are provided as sheet feeding and conveyance members. The pickup roller 8 is disposed above the downstream end of the placement plate 62. The pickup roller 8 feeds an uppermost one of the sheets S placed on the placement plate 62 toward the separation section 9 and then the image forming section 5*b* (registration roller pair 51). The separation section 9 is disposed downstream of the pickup roller 8 in the sheet conveyance direction. The separation section 9 includes a feed roller 91 and a retard roller 92. An upper roller of the separation section 9 in FIG. 2 is the feed roller 91. The feed roller 91 feeds downstream the sheet S fed by the pickup roller 8. That is, the feed roller 91 feeds the sheet S forward. A lower roller of the separation section 9 in FIG. 2 is the retard roller 92. The retard roller 92 is in contact with the feed roller 91 to form a nip. The retard roller 92 feeds the sheet S backward (direction toward cassette 61). That is, the retard roller 92 returns a sheet S involved in multiple sheet feeding toward the pickup roller 8. The feed roller 91 has higher conveyance power than the retard roller 92. As such, when a single sheet S is fed by the pickup roller 8 in the above configuration, the sheet S is conveyed downstream.

A support member 93 is disposed at a rotational shaft of the feed roller 91. The rotational shaft of the pickup roller 8 is supported by the support member 93. The support member 93 moves in an up-and-down direction. In the above configuration, the pickup roller 8 is also allowed to move in the up-and-down direction. When the placement plate 62 is raised, the pickup roller 8 is raised by the placement plate 62 in a state in which the sheets S are or are not placed thereon. As the downstream end of the placement plate 62 is raised, the pickup roller 8 comes in contact with the uppermost one of the sheets S. As illustrated in FIG. 3, the sheet feed section 6 includes an upper limit sensor 94. The upper limit sensor 94 detects reach of the pickup roller 8 to a predetermined upper limit position (see FIGS. 2 and 3). After the controller 2 causes the pickup roller 8 and the placement plate 62 to reach to the respective upper limit positions, sheet feeding is performed.

The upper limit sensor 94 changes an output level (high level or low level) of a signal between when the pickup roller 8 is and is not positioned at the upper limit position. The upper limit sensor 94 is for example a transmission type optical sensor. The controller 2 recognizes that the pickup roller 8 has reached the upper limit position according to the output level of the upper limit sensor 94. When the controller 2 recognizes that the pickup roller 8 has reached the upper limit position, the controller 2 stops the raising and lowering motor 64. In successive printing, the pickup roller 8 gradually descends in accompaniment to consumption of the sheets S. Each time the pickup roller 8 descends, the controller 2 causes the raising and lowering motor 64 to temporarily rotate. The pickup roller 8 is thus re-raised to the upper limit position.

When the sheet feed section 6 feeds the sheet S toward the conveyance section 5*a*, the controller 2 causes the sheet feed motor 65 and rollers of the separation section 9 to rotate. The rollers of the separation section 9 refer to the feed roller 91 and the retard roller 92. As illustrated in FIG. 3, the sheet feed section 6 includes a sheet feed motor 65 and a sheet feed clutch 66. Rotation of the sheet feed motor 65 rotates the pickup roller 8 and the rollers of the separation section 9. The sheet S is fed by friction force of the circumferential surface of the pickup roller 8. The sheet S is fed downstream by the pickup roller 8 and the separation section 9. The sheet feed clutch 66 is disposed in correspondence with the pickup roller 8. The sheet feed clutch 66 is an electromagnetic clutch. The controller 2 controls engagement and disengagement of the sheet feed clutch 66. When a specific time period elapses from rotation start of the pickup roller 8, the controller 2 disengages the sheet feed clutch 66 so that sheets S are not successively fed. Through the above disengagement, rotation of the pickup roller 8 is stopped. Thereafter, rotors disposed downstream of the separation section 9 convey the sheet S.

The sheet feed section 6 includes a sheet set sensor 67, an opening and closing sensor 68, and a size sensor 69. The sheet set sensor 67 detects presence or absence of a sheet S in the cassette 61. The opening and closing sensor 68 detects opening and closing of the cassette 61. The size sensor 69 detects the size of the sheet S placed on the placement plate 62. Outputs of the respective sensors are input to the controller 2.

The sheet feed section 6 further includes the speed sensor 81. The speed sensor 81 is disposed upstream of the pickup roller 8 in the sheet conveyance direction. The speed sensor 81 detects a conveyance speed of the sheet S fed from the placement plate 62 (also referred to below as a "sheet conveyance speed"). Output of the speed sensor 81 is input to the controller 2. The controller 2 recognizes the conveyance speed of the sheet S fed from the placement plate 62 based on the output of the speed sensor 81.

The speed sensor 81 detects the speed of a measurement target (sheet S) based on the Doppler effect. A sensor capable of irradiating the measurement target with light (a laser beam) can be adopted as the speed sensor 81. The speed sensor 81 includes a light emitting element and a photo detector. The light emitting element irradiates the measurement target with light having a specific frequency. The photo detector receives light reflected by the measurement target. Difference in frequency between the irradiation light and the reflected light differs according to the speed of the measurement target. The speed sensor 81 detects the conveyance speed of the sheet S based on the difference in frequency between the irradiation light and the reflected light. Note that another type of sensor may be adopted as the speed sensor 81. For example, a sensor that emits sound waves rather than the laser beam may be adopted as the speed sensor 81.

(Warning in Relation to Pickup Roller 8)

Figure 4:
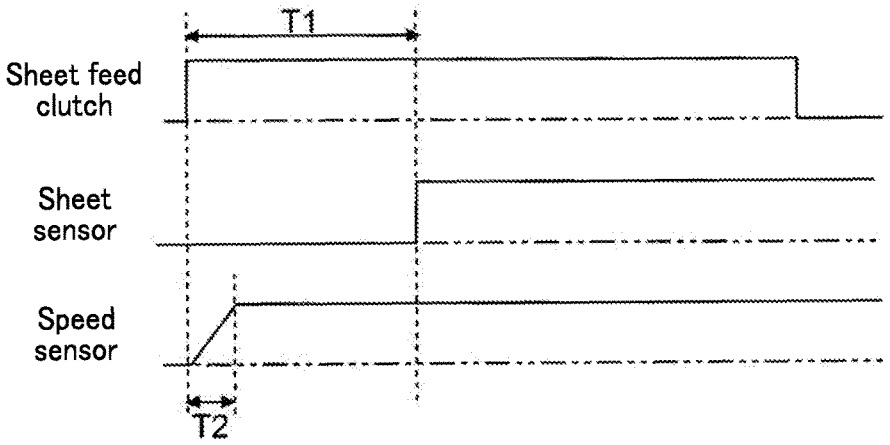
FIG. 4 is a diagram illustrating an example of output signals of respective sensors in a situation in which no slip occurs on a pickup roller and rollers of a separation section.
Figure 5:
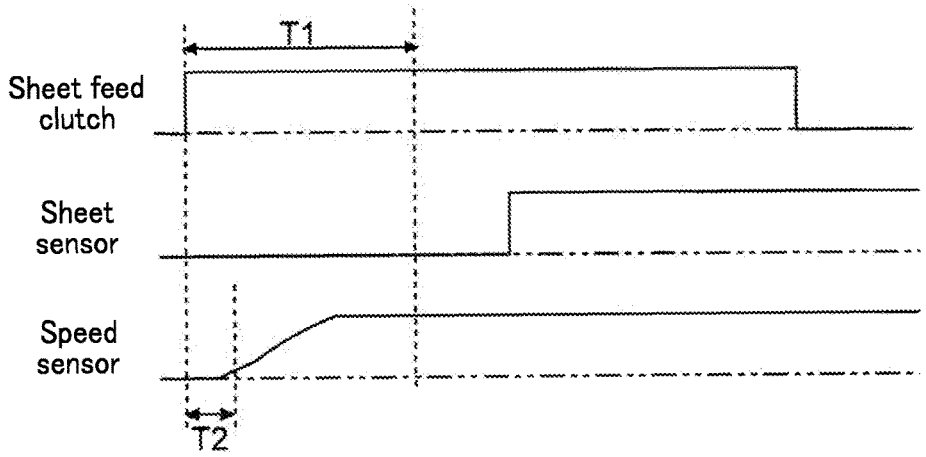
FIG. 5 is a diagram illustrating an example of output signals of the respective sensors in a situation in which a slip occurs on the pickup roller.
Figure 6:
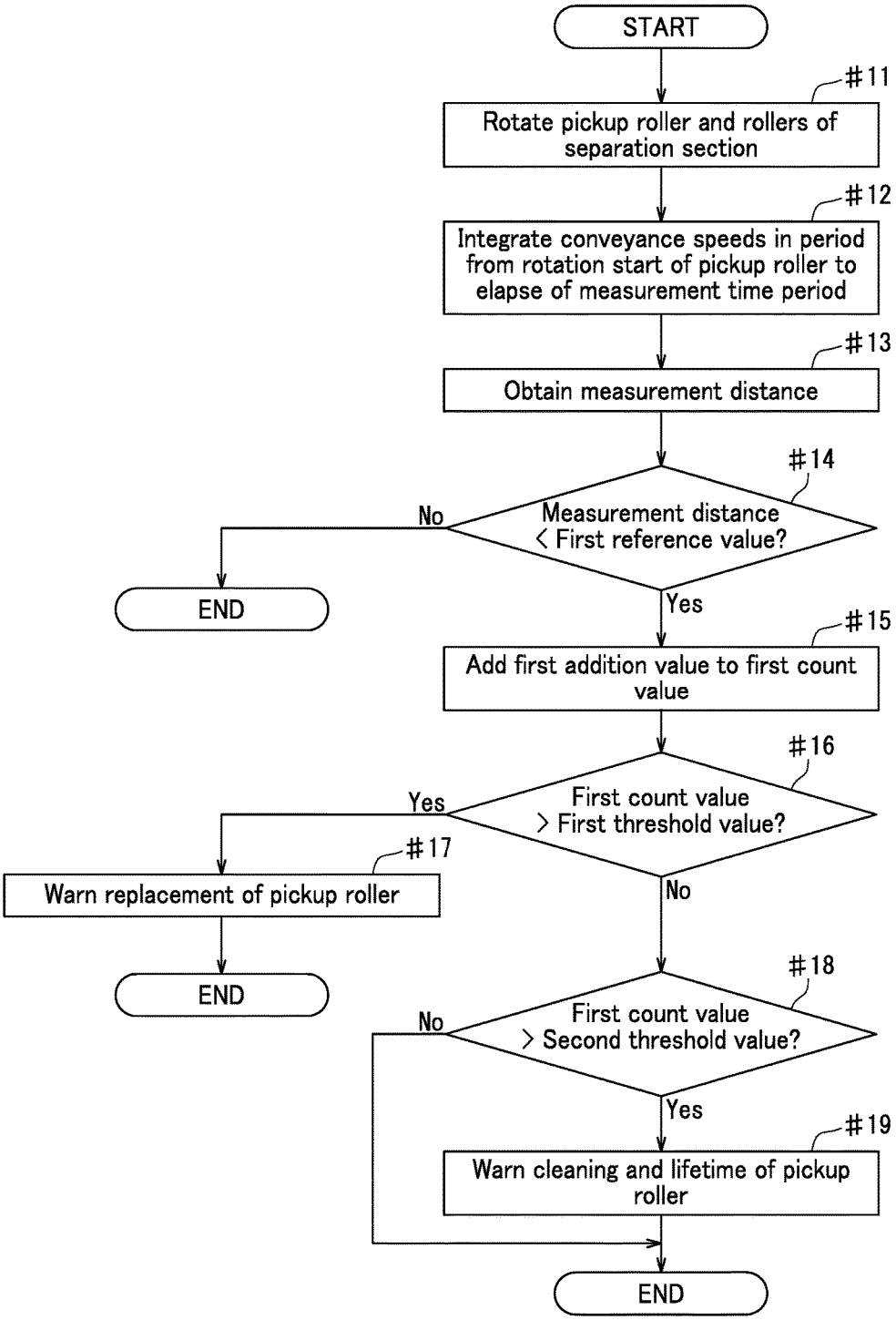
FIG. 6 is a flowchart illustrating an example of a flow of warning in relation to the pickup roller according to the embodiment.

The following describes an example of a flow of warning in relation to the pickup roller 8 according to the embodiment next with reference to FIGS. 4-6. FIG. 4 is a diagram illustrating an example of output signals of respective sensors in a situation in which no slip of the sheet S occurs on the pickup roller 8 and the rollers of the separation section 9. FIG. 5 is a diagram illustrating an example of output signals of the respective sensors in a situation in which a slip of the sheet S occurs on the pickup roller 8. FIG. 6 is a flowchart illustrating an example of a flow of warning in relation to the pickup roller 8 according to the embodiment.

In FIGS. 4 and 5, a time period T1 refers to an ideal time period from rotation start of the pickup roller 8 to time when the sheet sensor 5*s* detects leading edge arrival of the sheet S. In other words, T1 is a (theoretical) time period from rotation start of the pickup roller 8 to detection of leading edge arrival of the sheet S that is prescribed on the specification. A distance from a position of the leading edge of the sheet S ideally placed on the placement plate 62 to the sheet sensor 5*s* refers to a theoretical distance A [mm]. A conveyance speed of the sheet S prescribed on the specification (theoretical value of sheet conveyance speed) refers to a theoretical speed V [mm/s]. The time period T1 can be calculated using an expression A/V [s].

A time period T2 in FIGS. 4 and 5 is referred to as an ideal time period from rotation start of the pickup roller 8 to leading edge arrival of the sheet S at the nip of the rollers of the separation section 9. In other words, the time period T2 is a (theoretical) time period from rotation start of the pickup roller 8 to arrival of the sheet S at the nip that is prescribed on the specification. A distance from the position of the leading edge of the sheet S ideally placed on the placement plate 62 to the nip between the feed roller 91 and the retard roller 92 is referred to as a theoretical distance B [mm]. The theoretical distance B is smaller than the theoretical distance A (B<A). Further, the theoretical distance B is smaller than the length of the sheet S in a sub-scanning direction. The time period T2 can be calculated using an expression B/V [s].

FIG. 4 indicates a situation in which no slip occurs on the pickup roller 8 and the rollers of the separation section 9. When a sheet S is fed in an ideal manner, the leading edge of the sheet S quickly enters into the nip between the rollers of the separation section 9. The entrance of the sheet S coincides with an end of the time period T2. After the end of the time period T2, the sheet S is conveyed at a constant speed by the separation section 9. FIG. 5 indicates a situation in which a severe slip occurs on the pickup roller 8. In the above situation, the conveyance speed of the sheet S increases not so fast. As a result, detection of arrival of the sheet S by the sheet sensor 5*s* is delayed.

FIG. 6 illustrates an example of a flow of warning in relation to the pickup roller 8 when a single sheet S is fed. In successive printing on a plurality of sheets S, the processing depicted in the flowchart of FIG. 6 is executed on each sheet. Sheet feeding starts at START in FIG. 6 in execution of a print job (sheet feeding). First, the controller 2 causes the pickup roller 8 and the rollers (feed roller 91 and retard roller 92) of the separation section 9 to rotate (Step #11).

The controller 2 performs conveyance speed integration during a predetermined measurement time period (Step #12). The measurement time period refers to a time period from rotation start of the pickup roller 8 (switching on sheet feed motor 65 or engagement of sheet feed clutch 66) to elapse of a specific time period 3*a*. The specific time period 3*a* can be set at any appropriate value. In order to check the state of the pickup roller 8, it is preferable to check the output of the speed sensor 81 during the time when the rollers of the separation section 9 do not pertain to conveyance of the sheet S. The measurement time period is set to a time period during which only the pickup roller 8 conveys the sheet S. In other words, the pickup roller 8 conveys the sheet S while the rollers of the separation section 9 do not convey the sheet S during the measurement time period. Note that a clock circuit 23 that times the specific time period 3*a* is included in the controller 2 (see FIG. 3.). The specific time period 3*a* can be calculated using an expression (theoretical distance B)/(theoretical speed V) [s]. That is, the specific time period 3*a* corresponds to the time period T2. The specific time period 3*a* is stored in the storage 3.

Speed integration can result in distance calculation. The controller 2 performs conveyance speed integration to calculate a measurement distance that is a conveyance distance by which the sheet S is conveyed in the measurement time period (Step #13). Specifically, the speed sensor 81 periodically outputs a conveyance speed as a result of detection. The controller 2 accordingly recognizes the conveyance speed periodically. The controller 2 recognizes the conveyance speed for example each time 10 ms elapses. In a configuration for example in which the measurement time period is 100 ms, the controller 2 performs conveyance speed integration approximately ten times. The controller 2 integrates the respective conveyance speeds recognized in the measurement time period. The integration is a calculation for obtaining an area. As such, the controller 2 adds up values each obtained by multiplying a conveyance speed by a specific period. Alternatively, the integration may be performed through another calculation.

Next, the controller 2 determines whether or not the measurement distance calculated by integration is smaller than a first reference value (Step #14). That is, the controller 2 determines whether or not the conveyance distance by which the sheet S is conveyed in the measurement time period is smaller than a value as a reference. The first reference value will be described later in detail.

When the measurement distance is smaller than the first reference value (Yes at Step #14), the controller adds a first addition value 3*d* to a first count value 3*c* (Step #15). The first count value 3*c* is stored in a memory of the controller 2 or the storage 3. The first addition value 3*d* is for example 1. When the measurement distance is at least the first reference value (No at Step #14), the flow ends (END). In other words, the controller 2 does not add the first addition value 3*d* to the first count value 3*c*.

After Step #15, the controller 2 determines whether or not the first count value 3*c* exceeds a predetermined first threshold value 3*e* (Step #16). The first threshold value 3*e* can be set at any appropriate value. When the first count value 3*c* exceeds the first threshold value 3*e* (Yes at Step #16), the controller 2 causes the warning section to issue a warning to replace the pickup roller 8 (Step #17 and then the flow ends). A combination of the operation panel 4 (display panel 41) and the communication section 7 corresponds to the warning section. For example, the controller 2 causes the display panel 41 to display a message instructing to replace the pickup roller 8. The controller 2 also causes the communication section 7 to transmit the message instructing to replace the pickup roller 8 to the predetermined computer 200.

When the first count value 3*c* does not exceed the first threshold value 3*e* (No at Step #16), the controller 2 determines whether or not the first count value 3*c* exceeds a predetermined second threshold value 3*f* (Step #18). It is confirmed at Step #18 whether to warn that the lifetime of the pickup roller 8 is expiring although replacement of the pickup roller 8 is not yet necessary. In view of the foregoing, the second threshold value 3*f* is smaller than the first threshold value 3*e*. For example, the second threshold value 3*f* is 10 or 20 when the first threshold value 3*e* is 40.

When the first count value 3*c* exceeds the second threshold value 3*f* (Yes at Step #18), the controller 2 causes the warning section to issue a warning indicating that cleaning of the pickup roller 8 is necessary and the lifetime thereof is expiring (Step #19). The above warning is also referred to below as a "warning about cleaning and lifetime of the pickup roller 8". For example, the controller 2 causes the display panel 41 to display a message instructing to clean the pickup roller 8 and a warning that the lifetime thereof is expiring. The controller 2 also causes the communication section 7 to transmits the message instructing to clean the pickup roller 8 and the warning that the lifetime thereof is expiring to the predetermined computer 200. When the first count value 3*c* does not exceed the second threshold value 3*f* (No at Step #18) or after processing at Step #19, the flow ends.

The controller 2 sets a value obtained by multiplying a reference distance 3*b* by a first coefficient 3*g* as the first reference value. The first coefficient 3*g* is greater than 0 and no greater than 1. The reference distance 3*b* can be set at any appropriate value. For example, the reference distance 3*b* can be set according to an experiment. The reference distance 3*b* is based on a distance measured when the pickup roller 8 is abraded to a specific degree or less. For example, the reference distance 3*b* can be set in a manner that the controller 2 causes a brand-new pickup roller 8 to convey a plurality of sheets S. The controller 2 then integrates conveyance speeds measured in the measurement time period for each of the conveyed sheets S to calculate respective measurement distances and the average value of the respective measurement distances, which is calculated as the reference distance 3*b*, That is, the reference distance 3*b* can be set based on actual measurement values. The reference distance 3*b* can be set based on values obtained by actually performing integration. A slip may occur to some extent even if a roller is brand-new. The measurement distance may accordingly be less than the theoretical distance A even if the remaining lifetime of the pickup roller 8 is sufficiently long. In view of the foregoing, the reference distance 3*b* may be set shorter than the theoretical distance A.

The first reference value refers to a value obtained by multiplying the reference distance 3*b* by the first coefficient 3*g*. Sensitivity to detect abrasion of the pickup roller 8 increases as the first coefficient 3*g* is increased. That is, a possibility that the first addition value 3*d* is added to the first count value 3*c* increases as the first coefficient 3*g* is increased. The sensitivity to detect abrasion of the pickup roller 8 can be decreased by reducing the first coefficient 3*g*. That is, the possibility that the first addition value 3*d* is added to the first count value 3*c* decreases as the first coefficient 3*g* is reduced. The first coefficient 3*g* can be set at any appropriate value.

(Warning in Relation to Rollers of Separation Section 9)

Figure 7:
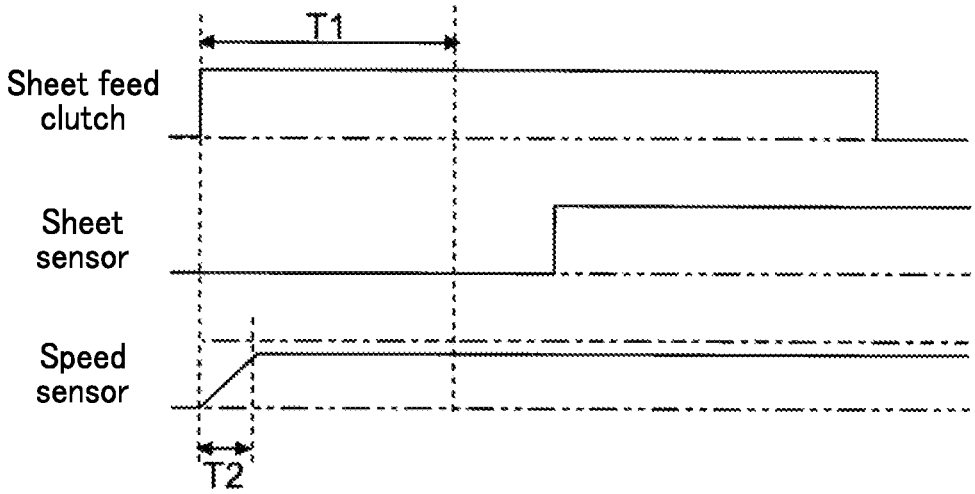
FIG. 7 is a diagram illustrating an example of output signals of the respective sensor in a situation in which a slip occurs on the rollers of the separation section.
Figure 8:
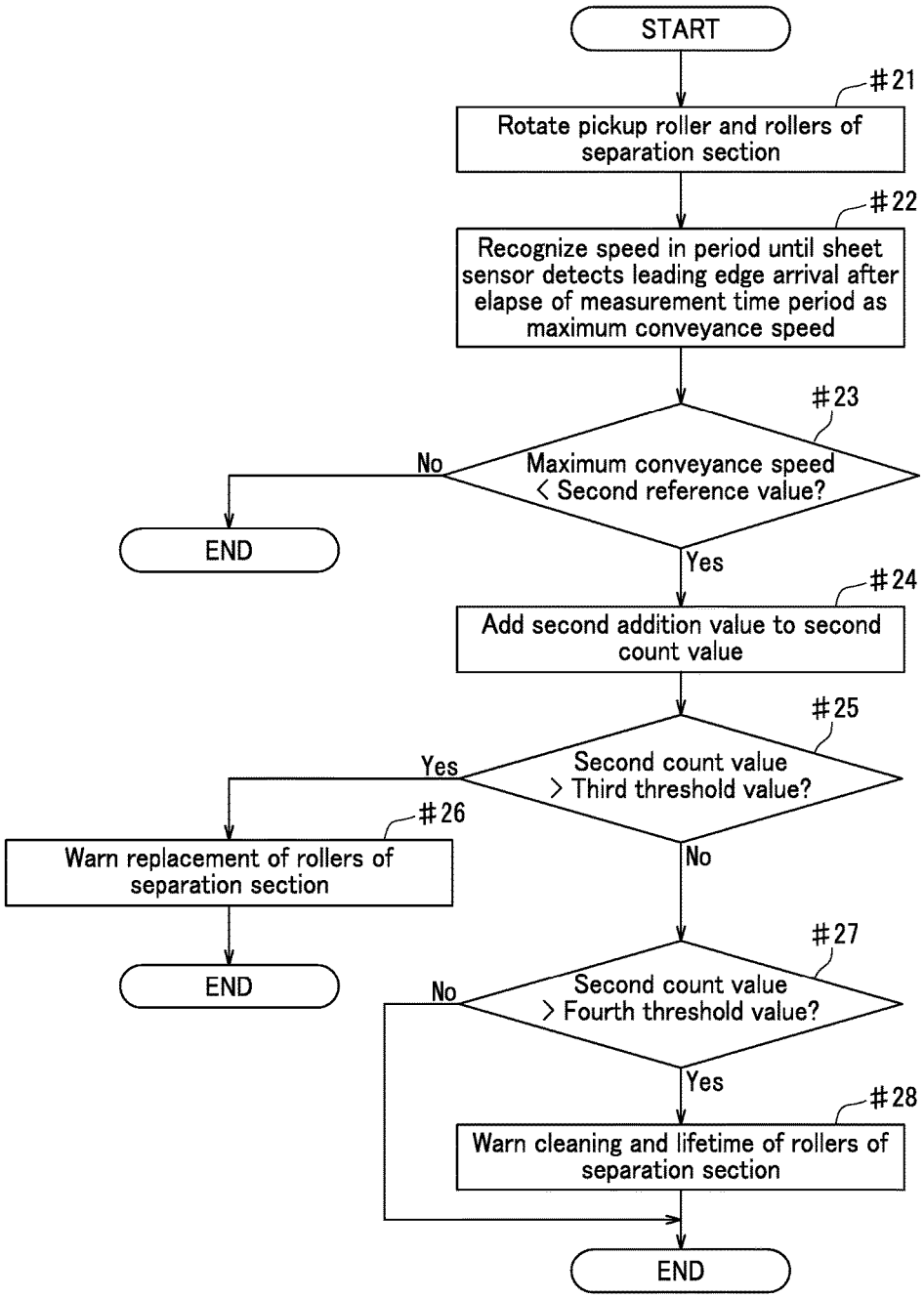
FIG. 8 is a flowchart illustrating an example of a flow of warning in relation to the rollers of the separation section according to the embodiment.

The following describes an example of a flow of warning in relation to the rollers of the separation section 9 according to the embodiment next with reference to FIGS. 7 and 8. FIG. 7 is a diagram indicating an example of output signals of the respective sensors when a slip occurs on the rollers of the separation section 9. FIG. 8 is a flowchart illustrating an example of a flow of warning in relation to the rollers of the separation section 9 according to the embodiment.

The time periods T1 and T2 in FIG. 7 are the same as those in FIGS. 4 and 5. FIG. 7 indicates a situation in which a slip occurs on the rollers of the separation section 9. It is known that a maximum conveyance speed decreases in the above situation. As a result, detection of arrival of the sheet S by the sheet sensor 5*s* is delayed. That is, conveyance of the sheet S is delayed.

FIG. 8 illustrates an example of a flow of warning in relation to the rollers of the separation section 9 when a single sheet S is fed. When multiple sheets S are successively printed, the processing depicted in the flowchart of FIG. 8 is executed on each of the sheets S. Sheet feeding starts at START in FIG. 8 to execute a print job (sheet feeding). First, the controller 2 causes the pickup roller 8 and the rollers (feed roller 91 and retard roller 92) of the separation section 9 to rotate (Step #21).

The controller 2 recognizes the sheet conveyance speed in a time period from elapse of the measurement time period until the sheet sensor 5*s* detects leading edge arrival of a sheet S (Step #22) as a maximum value of the sheet conveyance speed (maximum conveyance speed) in conveyance of the sheet S. After the sheet S enters into the nip of the separation section 9, the rollers of the separation section 9 convey the sheet S. In view of the above, the maximum conveyance speed after elapse of the measurement time period is recognized as the maximum conveyance speed in relation to the rollers of the separation section 9. In the above configuration, an abrasion degree of the rollers of the separation section 9 can be understood.

The controller 2 then determines whether or not the maximum conveyance speed is smaller than a second reference value (Step #23). That is, the controller 2 performs calculation for the maximum conveyance speed and then determines whether or not the maximum conveyance speed decreases due to abrasion of the rollers of the separation section 9. The second reference value will be described later in detail. When the maximum conveyance speed is smaller than the second reference value (Yes at Step #23), the controller 2 adds a second addition value 3J to a second count value 3*i* (Step #24). The second count value 3*i* is stored in memory of the controller 2 or the storage 3. The second addition value 3J is 1, for example. When the maximum conveyance speed is at least the second reference value (No at Step #23), the flow ends (END). In other words, the controller 2 does not add the second addition value 3J to the second count value 3*i*.

After Step #24, the controller 2 determines whether or not the second count value 3*i* exceeds a predetermined third threshold value 3*k* (Step #25). The third threshold value 3*k* can be set at any appropriate value. When the second count value 3*i* exceeds the third threshold value 3*k* (Yes at Step #25), the controller 2 causes the warning section to issue a warning to replace the rollers of the separation section 9 (Step #26 and then the flow ends). For example, the controller 2 causes the display panel 41 to display a message instructing to replace the rollers of the separation section 9. The controller 2 also causes the communication section 7 to transmit the message instructing to replace the rollers of the separation section 9 to the predetermined computer 200.

When the second count value 3*i* does not exceed the third threshold value 3*k* (No at Step #25), the controller 2 determines whether or not the second count value 3*i* exceeds a predetermined fourth threshold value 3L (Step #27). It is determined at Step #27 whether to issue a warning that the lifetime of the rollers of the separation section 9 is expiring. In view of the foregoing, the fourth threshold value 3L is smaller than the third threshold value 3*k*. For example, the fourth threshold value 3L is 10 or 20 when the third threshold value 3*k* is 40.

When the second count value 3*i* exceeds the fourth threshold value 3L (Yes at Step #27), the controller 2 causes the warning section to issue a warning that cleaning of the rollers of the separation section 9 is necessary and that the lifetime thereof is expiring (Step #28). The above warning may be also referred to below as a "warning about cleaning and lifetime of the rollers of the separation section 9". For example, the controller 2 causes the display panel 41 to display a message instructing to clean the rollers of the separation section 9 and a warning about the lifetime thereof. The controller 2 also causes the communication section 7 to transmit the message instructing to clean the rollers of the separation section 9 and the warning about the lifetime thereof to the predetermined computer 200. When the second count value 3*i* does not exceed the fourth threshold value 3L (No at Step #27) or after the processing at Step #28, the flow ends.

The controller 2 sets as the second reference value a value obtained by multiplying a reference speed 3*h* by a second coefficient 3*m*. The second coefficient 3*m* is greater than 0 and no greater than 1. The reference speed 3*h* can be set at any appropriate value. For example, the reference speed 3*h* is a sheet conveyance speed prescribed on the specification. That is, the reference speed 3*h* is for example the theoretical speed V. A slip may occur on the rollers of the separation section 9 to some extent even in a situation in which the separation section 9 is brand-new. The maximum conveyance speed may be lower than the theoretical speed V even in a situation in which a remaining lifetime of the rollers of the separation section 9 is sufficiently long. In view of the foregoing, the reference speed 3*h* may be set lower than the theoretical speed V For example, consider that the separation section 9 is brand-new and multiple sheets S are conveyed. The controller 2 determines a maximum conveyance speed of each sheet conveyed. The controller 2 then calculates the average speed of each maximum conveyance speed as the reference speed 3*h*.

The second reference value is a value obtained by multiplying the reference speed 3*h* by the second coefficient 3*m*. Sensitivity to detect abrasion of the rollers of the separation section 9 is increased as the second coefficient 3*m* is increased. That is, a possibility that the second addition value 3J is added to the second count value 3*i* increases as the second coefficient 3*m* is increased. The sensitivity to detect abrasion of the rollers of the separation section 9 can be decreased by reducing the second coefficient 3*m*. That is, the possibility that the second addition value 3J is added to the second count value 3*i* decreases as the second coefficient 3*m* is decreased. The second coefficient 3*m* can be set at any appropriate value.

(Setting of First and Second Coefficients 3*g* and 3*m*)

Figure 9:
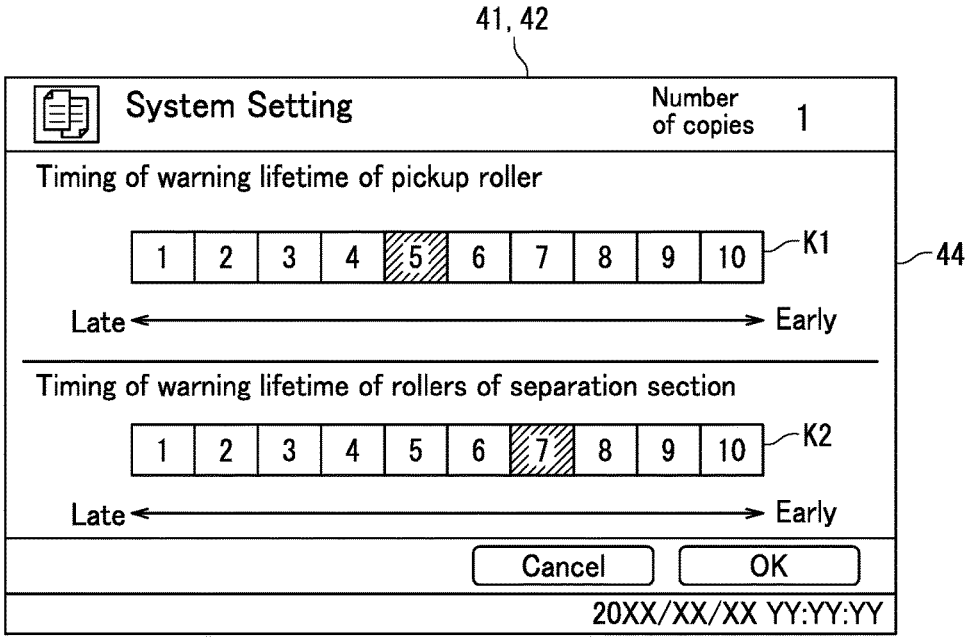
FIG. 9 is a diagram illustrating an example of a coefficient setting screen according to the embodiment.

The following describes an example of setting of the first and second coefficients 3*g* and 3*m* according to the embodiment next with reference to FIG. 9. FIG. 9 illustrates an example of a coefficient setting screen 44 according to the embodiment.

The operation panel 4 receives operations to set the first and second coefficients 3*g* and 3*m*. The user is allowed to set the first and second coefficients 3*g* and 3*m* through the coefficient setting screen 44. FIG. 9 illustrates an example of the coefficient setting screen 44. When a prescribed operation is done on the operation panel 4, the controller 2 causes the display panel 41 to display the coefficient setting screen 44.

The first coefficient 3*g* can be set through a first coefficient level setting button set K1. The first coefficient level setting button set K1 includes ten buttons for setting a level of the first coefficient 3*g*. The buttons are each labeled with a numeral indicating a level of the first coefficient 3*g*. The user can set a level of the first coefficient 3*g* by touching a site where one of the buttons is displayed. FIG. 9 illustrates a situation in which a level "5" is selected for the first coefficient 3*g*. The larger the selected level is, the larger the first coefficient 3*g* calculated by the controller 2 is. The smaller the selected level is, the smaller the first coefficient 3*g* calculated by the controller 2 is. The controller 2 calculates the first coefficient 3*g* for example using the following expression (Formula 1). The controller 2 determines as the first reference value a value obtained by multiplying the reference distance 3*b* by the first coefficient 3*g* corresponding to the level thereof set through the operation panel 4.

$$(\text{first coefficient } 3g)=0.5+(0.05\times(\text{numeral of selected level})) \quad \text{(Formula 1)}$$

The second coefficient 3*m* can be set using a second coefficient level setting button set K2. The second coefficient level setting button set K2 also includes ten buttons for setting a level of the second coefficient 3*m*. The buttons are each labeled with a numeral indicating a level. The user can set a level of the second coefficient 3*m* by touching a site where one of the buttons is displayed. FIG. 9 illustrates a situation in which a level "7" is selected for the second coefficient 3*m*. The larger the selected level is, the larger the second coefficient 3*m* calculated by the controller 2 is. The smaller the selected level is, the smaller the second coefficient 3*m* calculated by the controller 2 is. The controller 2 calculates the second coefficient 3*m* for example using the following expression (Formula 2). The controller 2 determines as the second reference value a value obtained by multiplying the reference speed 3*h* by the second coefficient 3*m* corresponding to the level thereof set through the operation panel 4.

$$(\text{second coefficient } 3m)=0.5+(0.05\times(\text{numeral of selected level})) \quad \text{(Formula 2)}$$

Note that the storage 3 (see FIG. 1) stores in a volatile manner therein the specific time period 3*a*, the reference distance 3*b*, the first count value 3*c*, the first addition value 3*d*, the first threshold value 3*e*, the second threshold value 3*f*, the first coefficient 3*g*, the reference speed 3*h*, the second count value 3*i*, the second addition value 3J, the third threshold value 3*k*, the fourth threshold value 3L, and the second coefficient 3*m*, which are necessary for calculation and control. To achieve the above configuration, the storage 3 may be included in the sheet feed conveyance device 1.

As described above, the sheet feed conveyance device 1 according to the embodiment includes the warning section (display panel 41 and communication section 7), the pickup roller 8, the separation section 9, the speed sensor 81, and the controller 2. The warning section issues a warning. The pickup roller 8 feeds a sheet S placed on the placement plate 62. The separation section 9 is disposed downstream of the pickup roller 8 in the sheet conveyance direction. The separation section 9 includes the feed roller 91 and the retard roller 92. The feed roller 91 feeds downstream the sheet S fed by the pickup roller 8. The retard roller 92 is in contact with the feed roller 91 to form a nip and returns a sheet S involved in multiple sheet feeding toward the pickup roller 8. The speed sensor 81 is disposed upstream of the pickup roller 8 in the sheet conveyance direction. The speed sensor 81 detects the conveyance speed of the sheet S fed from the placement plate 62. The controller 2 causes the pickup roller 8 to rotate during sheet feeding. The controller 2 recognizes the conveyance speed based on output of the speed sensor 81. The controller 2 integrates the conveyance speeds detected in the measurement time period from rotation start of the pickup roller 8 to elapse of the specific time period 3*a*. The controller 2 determines necessity for maintenance of the pickup roller 8 according to a measurement distance that is a conveyance distance as a result of integration. Upon determining that maintenance of the pickup roller 8 is necessary, the controller 2 causes the warning section to issue a warning about maintenance of the pickup roller 8.

In the above configuration, the speed at which the pickup roller 8 feeds the sheet S can be recognized. The conveyance speed of the sheet S fed by the pickup roller 8 can accordingly be monitored. In the above configuration, the conveyance distance by which the sheet S is conveyed in the measurement time period (the specific time period 3*a*, from sheet feed start) can be obtained. A sheet conveyance state can accordingly be recognized with precision based on the sheet conveyance speed. When abrasion of the pickup roller 8 advances, a slip tends to readily occur. The more severe a slip is, the less the conveyance speed of the sheet S increases. The conveyance distance becomes short as abrasion of the pickup roller 8 advances. Necessity for maintenance of the pickup roller 8 can be warned about with appropriate timing based on an actual sheet conveyance state. As a result, deficiency of the pickup roller 8 can be precisely determined and warned about.

When the measurement distance is smaller than the first reference value set based on the predetermined reference distance 3*b*, the controller 2 adds the first addition value 3*d* to the first count value 3*c*. By contrast, when the measurement distance is at least the first reference value, the controller 2 does not add the first addition value 3*d* to the first count value 3*c*. When the first count value 3*c* exceeds the predetermined first threshold value 3*e*, the controller 2 causes the warning section to issue a warning to replace the pickup roller 8. In the above configuration, the number of times that the conveyance distance in the measurement time period is less than a value as a reference can be counted. As abrasion of the pickup roller 8 advances, a slip may tend to readily occur. When a slip occurs, the conveyance speed of the sheet S fed to the pickup roller 8 decreases. The first count value 3*c* indicates the number of times that the conveyance speed in the measurement time period is smaller than a value as a reference. The controller 2 can precisely detect based on the first count value 3*c* that a state in which the conveyance speed of the sheet S fed by the pickup roller 8 is low persists. When abrasion of the pickup roller 8 advances to such a degree that replacement of the pickup roller 8 is necessary, the warning section issues a warning to replace the pickup roller 8. The warning section can issue a warning that abrasion of the pickup roller 8 is considerably advancing and that early replacement is necessary. The warning section can issue a warning to replace the pickup roller 8 with appropriate timing.

Moreover, when the first count value 3*c* exceeds the predetermined second threshold value 3*f*, the controller 2 causes the warning section to issue a warning about the cleaning and lifetime of the pickup roller 8. The second threshold value 3*f* is smaller than the first threshold value 3*e*. In other words, the controller sets a value smaller than (for example, a half or less of) the first threshold value 3*e* as the second threshold value 3*f* The controller 2 can detect abrasion or contamination of the pickup roller 8 based on the first count value 3*c*. The controller 2 can precisely detect performance impairment of the pickup roller 8 caused by abrasion or contamination. When abrasion of the pickup roller 8 advances, the warning section can issue a warning to consider replacement of the pickup roller 8.

Further, the controller 2 sets as the first reference value a value obtained by multiplying the reference distance 3*b* by the first coefficient 3*g*. The reference distance 3*b* is a value set based on a conveyance distance obtained by integration of the conveyance speeds detected in a time period from rotation start of the pickup roller 8 to elapse of the specific time period 3*a* in a situation in which the pickup roller is abraded to a specific degree or less. The first coefficient 3*g* is greater than 0 and no greater than 1. In the above configuration, comparison can be made between the first reference value and a conveyance distance of the sheet S in a period when the sheet S is fed by only the pickup roller 8 (measurement time period). The controller 2 can adjust timing of issuance of a warning in relation to the pickup roller 8. A possibility of addition to the first count value 3*c* increases as the first coefficient 3*g* is increased. As a result, abrasion of the pickup roller 8 can be understood sensitively. By contrast, the possibility of addition to the first count value 3*c* is decreased by reducing the first coefficient 3*g*. As a result, sensitivity to abrasion of the pickup roller 8 can be reduced.

The sheet feed conveyance device 1 further includes the operation panel 4 that receives an operation to set the first coefficient 3*g*. The controller 2 sets as the first reference value a value obtained by multiplying the reference distance 3*b* by the first coefficient 3*g* set through the operation panel 4. The user can set the first coefficient 3*g* through the operation panel 4. In a situation in which productivity (printing speed) is considered important, the user may set the first coefficient 3*g* to be large. In a situation in which it is desired to avoid replacement of the pickup roller 8 as far as possible in view of the cost, the user may set the first coefficient 3*g* to be small. The first coefficient 3*g* according to user's intention can be set.

The sheet feed conveyance device 1 further includes the sheet sensor 5*s* that is disposed downstream of the separation section 9 in the sheet conveyance direction and that detects arrival and passing of the sheet S. The controller 2 causes the rollers of the separation section 9 to rotate in sheet feeding. The controller 2 recognizes the conveyance speed based on output of the speed sensor 81. The controller 2 recognizes as a maximum conveyance speed the conveyance speed detected in a time period from elapse of the measurement time period to detection of leading edge arrival of the sheet S by the sheet sensor 5*s*. The controller 2 performs calculation for the maximum conveyance speed to determine necessity for maintenance of the rollers of the separation section 9 based on a calculated value. Upon determining that the maintenance for the rollers of the separation section 9 is necessary, the controller 2 causes the warning section to issue a warning about maintenance of the rollers of the separation section 9. As abrasion of the rollers of the separation section 9 advances, the maximum conveyance speed decreases. In the above configuration, the speed of the sheet S fed by the rollers of the separation section 9 can be recognized. The conveyance speed of the sheet S fed by the rollers of the separation section 9 can accordingly be monitored. In other words, the warning section can issue a warning about necessity for maintenance of the rollers of the separation section 9 with appropriate timing based on the maximum speed detected in the time period from elapse of the measurement time period to detection of sheet arrival by the sheet sensor 5*s*.

The controller 2 adds the second addition value 3J to the second count value 3*i* when the maximum conveyance speed is smaller than the second reference value set based on the predetermined reference speed 3*h*. By contrast, when the maximum conveyance speed is at least the second reference value, the controller 2 does not add the second addition value 3J to the second count value 3*i*. When the second count value 3*i* exceeds the predetermined third threshold value 3*k*, the controller 2 causes the warning section to issue a warning to replace the rollers of the separation section 9. In the above configuration, the number of times that the maximum conveyance speed of the sheet S fed by the separation section 9 until the sheet sensor 5*s* detects arrival of the sheet S is less than a value as a reference value can be counted. As abrasion of the rollers of the separation section 9 advances, a slip tends to readily occur. The maximum conveyance speed of the sheet S fed by the rollers of the separation section 9 accordingly decreases. The second count value 3*i* indicates the number of times that the conveyance speed of the sheet S conveyed by the rollers of the separation section 9 is less than a value as a reference value. Accordingly, the controller 2 can precisely determine based on the second count value 3*i* that a state in which the maximum conveyance speed of the sheet S fed by the rollers of the separation section 9 is low persists. When the controller 2 determines by referencing the third threshold value 3*k* as a reference that abrasion of the rollers of the separation section 9 has advanced to such a degree that replacement of the rollers of the separation section 9 is necessary, the warning section issues a warning to replace the rollers of the separation section 9. In the above configuration, the warning section can issue a warning about immediate replacement of the rollers of the separation section 9 when abrasion of the rollers thereof considerably advances. As a result, replacement of the rollers of the separation section 9 can be warned about with appropriate timing.

Furthermore, when the second count value 3*i* exceeds the predetermined fourth threshold value 3L, the controller 2 causes the warning section to issue the warning about cleaning and lifetime of the rollers of the separation section 9. The fourth threshold value 3L is smaller than the third threshold value 3*k*. In other words, the controller 2 sets the fourth threshold value 3L to be smaller than (for example, a half or less of) the third threshold value 3*k*. The controller 2 can precisely detect based on the second count value 3*i* that performance of the rollers of the separation section 9 is impaired due to abrasion or contamination. In the above configuration, the controller 2 can cause the warning section to issue a warning to consider replacement with appropriate timing in a situation in which abrasion of the rollers of the separation section 9 is advancing.

The controller 2 sets as the second reference value a value obtained by multiplying the reference speed 3*h* by the second coefficient 3*m*. The reference speed 3*h* is a sheet conveyance speed prescribed on the specification. The second coefficient 3*m* is greater than 0 and no greater than 1. In the above configuration, the controller 2 can adjust timing of warning in relation to the rollers of the separation section 9. As the second coefficient 3*m* is increased, a possibility of addition to the second count value 3*i* increases. As a result, abrasion of the rollers of the separation section 9 can be understood sensitively. By contrast, the possibility of addition to the second count value 3*i* is decreased by reducing the second coefficient 3*m*. As a result, sensitivity to abrasion of the rollers of the separation section 9 can be reduced.

The sheet feed conveyance device 1 further includes the operation panel 4 that receives an operation to set the second coefficient 3*m*. The controller 2 sets as the second reference value a value obtained by multiplying the reference distance 3*b* by the second coefficient 3*m* set through the operation panel 4. The user can set the second coefficient 3*m*. In a situation in which productivity (printing speed) is considered important, the user may set the second coefficient 3*m* to be large. In a situation in which it is desired to avoid replacement of the rollers of the separation section 9 as far as possible in view of the cost, the user may set the second coefficient 3*m* to be small. The second coefficient 3*m* can be set according to an intention of the user.

An image forming apparatus (multifunction peripheral) includes the above sheet feed conveyance device 1 and an image forming section 5*b*. The image forming section 5*b* forms an image on a sheet S conveyed by the sheet feed conveyance device 1. The controller 2 can precisely recognize a state of the sheet S being conveyed by the respective rollers pertaining to sheet feeding based on the conveyance speed of the sheet S that is a detection result. As a result, an image forming apparatus can be provided that can precisely determine deficiency of a roller and issue a warning.

The embodiment of the present disclosure has been described so far. However, the scope of the present disclosure is of course not limited to the above embodiment and various alterations may be adopted in implementation so long as such alterations do not deviate from the essence of the present disclosure.

What is claimed is:

1. A sheet feed conveyance device comprising:

a warning section configured to issue a warning;

a pickup roller configured to feed a sheet placed on a placement plate;

a separation section disposed downstream of the pickup roller in a conveyance direction of the sheet and including a feed roller and a retard roller, the feed roller feeding downstream the sheet fed by the pickup roller, the retard roller being in contact with the feed roller to form a nip and returning a sheet involved in multiple sheet feeding toward the pickup roller;

a speed sensor disposed upstream of the pickup roller in the conveyance direction and configured to detect a conveyance speed of the sheet fed from the placement plate; and a controller configured to:

cause the pickup roller to rotate during sheet feeding;

recognize the conveyance speed based on output of the speed sensor;

integrate conveyance speeds detected in a measurement time period, the measurement time period being a time period from rotation start of the pickup roller to elapse of a specific time period;

determine necessity for maintenance of the pickup roller according to a measurement distance that is a conveyance distance as a result of integration; and upon determining that maintenance of the pickup roller is necessary, cause the warning section to issue a warning about maintenance of the pickup roller.

2. The sheet feed conveyance device according to claim 1, wherein the controller adds a first addition value to a first count value when the measurement distance is smaller than a first reference value set based on a predetermined reference distance, and does not add the first addition value to the first count value when the measurement distance is at least the first reference value, and when the first count value exceeds a predetermined first threshold value, the controller causes the warning section to issue a warning to replace the pickup roller.

3. The sheet feed conveyance device according to claim 2, wherein when the first count value exceeds a predetermined second threshold value, the controller causes the warning section to issue a warning that cleaning of the pickup roller is necessary and lifetime thereof is expiring, and the second threshold value is smaller than the first threshold value.

4. The sheet feed conveyance device according to claim 2, wherein the controller sets as the first reference value a value obtained by multiplying the predetermined reference distance by a first coefficient, the predetermined reference distance is a value set based on a conveyance distance obtained by integration of the conveyance speeds detected in the measurement time period from rotation start of the pickup roller to elapse of the specific time period in a situation in which the pickup roller is abraded to a specific degree or less, and the first coefficient is greater than 0 and no greater than 1.

5. The sheet feed conveyance device according to claim 4, further comprising an operation panel configured to receive an operation to set the first coefficient, wherein the controller sets as the first reference value a value obtained by multiplying the predetermined reference distance by the first coefficient, the first coefficient being a value set through the operation panel.

6. The sheet feed conveyance device according to claim 1, further comprising a sheet sensor disposed downstream of the separation section in the conveyance direction and configured to detect arrival and passing of the sheet, wherein the controller causes the feed roller and the retard roller that are rollers of the separation section to rotate during sheet feeding, recognizes the conveyance speed based on output of the speed sensor, recognizes as a maximum conveyance speed a conveyance speed detected in a time period from elapse of the measurement time period to detection of arrival of a leading edge of the sheet by the sheet sensor, performs calculation for the maximum conveyance speed, and determines necessity for maintenance of the rollers of the separation section based on a calculated value, and upon determining that maintenance for the rollers of the separation section is necessary, the controller causes the warning section to issue a warning about maintenance of the rollers of the separation section.

7. The sheet feed conveyance device according to claim 6, wherein the controller adds a second addition value to a second count value when the maximum conveyance speed is smaller than a second reference value set based on a predetermined reference speed, and does not add the second addition value to the second count value when the maximum conveyance speed is at least the second reference value, and when the second count value exceeds a predetermined third threshold value, the controller causes the warning section to issue a warning to replace the rollers of the separation section.

8. The sheet feed conveyance device according to claim 7, wherein when the second count value exceeds a predetermined fourth threshold value, the controller causes the warning section to issue a warning that cleaning of the rollers of the separation section is necessary and lifetime thereof is expiring, and the fourth threshold value is smaller than the third threshold value.

9. The sheet feed conveyance device according to claim 7, wherein the controller sets as the second reference value a value obtained by multiplying the reference speed by a second coefficient, the reference speed is a conveyance speed of a sheet prescribed on a specification, and the second coefficient is greater than 0 and no greater than 1.

10. The sheet feed conveyance device according to claim 9, further comprising an operation panel configured to receive an operation to set the second coefficient, wherein the controller sets as the second reference value a value obtained by multiplying a predetermined reference distance by the second coefficient, the second coefficient being a value set through the operation panel.

11. The sheet feed conveyance device according to claim 1, wherein during the measurement time period, the pickup roller conveys the sheet while the rollers of the separation section do not convey the sheet.

12. An image forming apparatus comprising:

the sheet feed conveyance device according to claim 1; and an image forming section configured to form an image on the sheet conveyed by the sheet feed conveyance device.

* * * * *